US012564753B2

(12) United States Patent
Pizer et al.

(10) Patent No.: US 12,564,753 B2
(45) Date of Patent: Mar. 3, 2026

(54) OPEN TRAP-CAMBER BAR WITH SELF-BRACING REMOVABLE HANDLES

(71) Applicant: Rep Fitness LLC, Boulder, CO (US)

(72) Inventors: Samuel M. Pizer, Denver, CO (US); Ryan James McGrotty, Erie, CO (US); John Hibberts, Denver, CO (US)

(73) Assignee: Rep Fitness LLC, Westminster, CO (US)

( * ) Notice: Subject to any disclaimer, the term of this patent is extended or adjusted under 35 U.S.C. 154(b) by 120 days.

(21) Appl. No.: 18/332,853

(22) Filed: Jun. 12, 2023

(65) Prior Publication Data

US 2023/0398398 A1 Dec. 14, 2023

Related U.S. Application Data

(60) Provisional application No. 63/351,847, filed on Jun. 14, 2022.

(51) Int. Cl.
*A63B 21/072* (2006.01)
*A63B 21/00* (2006.01)

(52) U.S. Cl.
CPC ..... *A63B 21/0724* (2013.01); *A63B 21/0728* (2013.01); *A63B 21/4035* (2015.10)

(58) Field of Classification Search
CPC ..... A63B 21/0724; A63B 21/0728; A63B 21/4035; A63B 21/0722; A63B 2023/0411; A63B 21/4039
See application file for complete search history.

(56) References Cited

U.S. PATENT DOCUMENTS 4,360,198 A 11/1982 Waulters
6,004,245 A 12/1999 Boos
(Continued)

FOREIGN PATENT DOCUMENTS

CN 215841404 U * 2/2022
EP 3662979 A1 6/2020
(Continued)

OTHER PUBLICATIONS

Bells of Steel, Arch Nemesis Swiss Bar, located online at: http://web.archive.org/web/20220923224530/https://www.bellsofsteel.us/all-products/barbells/specialty-barbells/swiss-bar/?utm_source=google&utm_medium=cpc&utm_campaign=pm-hi-mrg-shp&gclid=Cj0KCQjwsrWZBhC4ARIsAGGUJurIN6HFNvwYJcEre7baivOCYApfAUb7y40kW5eEmbPgjOSkf2c_5L0aAjmLEALw_wcB, dated Sep. 23, 2022, offered for sale as early as Jun. 24, 2022, 7 pages.
(Continued)

*Primary Examiner* — Andrew M Kobylarz
(74) *Attorney, Agent, or Firm* — NOD Law PC

(57) ABSTRACT

An exercise device includes a substantially U-shaped bar having an interface at each end. A leg secured to each interface includes a pair of tapered projections extending from the interface. The leg defines a leg opening. A plate-support post secured to each interface includes a first, plate-receiving end extending away from the interface and second end disposed within the interface and defining a threaded bore. A handle unit is removably secured proximate each interface and includes a handle base at least partially defining a handle opening and a pair of receivers. A screw removably secures each handle unit to the leg proximate each interface and extends into the handle and leg openings and is threadably received in the threaded bore. When the screw is received in the threaded bore, each of the pair of receivers receives one of the pair of tapered projections.

14 Claims, 6 Drawing Sheets

(56) References Cited

U.S. PATENT DOCUMENTS

| | | | | |
|---|---|---|---|---|
| 8,951,170 | B1 | 2/2015 | Tayo | |
| 9,254,408 | B1 | 2/2016 | Otto | |
| 9,833,654 | B1 | 12/2017 | Gant et al. | |
| D834,660 | S | 11/2018 | Petek | |
| D845,404 | S | 4/2019 | Kukua | |
| D889,570 | S | 7/2020 | Petek | |
| D898,134 | S | 10/2020 | Hitman | |
| 10,881,893 | B2 * | 1/2021 | Welde | A63B 21/0724 |
| D916,214 | S | 4/2021 | Gonzales | |
| 11,235,192 | B1 | 2/2022 | Thomas | |
| 11,241,601 | B2 * | 2/2022 | Sorin | A63B 21/0728 |
| 2016/0051857 | A1 | 2/2016 | Rasner | |
| 2020/0230457 | A1 * | 7/2020 | Vanderbleek | A63B 23/0405 |
| 2023/0414988 | A1 * | 12/2023 | Leipheimer | A63B 21/0724 |

FOREIGN PATENT DOCUMENTS

| | | | | |
|---|---|---|---|---|
| EP | 4295925 | A2 * | 12/2023 | A63B 21/0722 |
| GB | 6229019 | S | 9/2022 | |
| GB | 6229020 | S | 9/2022 | |

OTHER PUBLICATIONS

Eleiko, Oppen Deadlift Bar, located at: https://eleiko.com/en-us/equipment/bars/specialty/3085153-03-eleiko-oppen-deadlift-bar-black?utm_term=eleiko%20open%20trap%20bar&utm_campaign=US+%7C+Brand+%7C%C2%AOEleiko+Products&utm_source=adwords&utm_medium=ppc&hsa_acc=3397350135&hsa_cam=12260573641&hsa_grp=120748517726&hsa_ad=525817879876&hsa_src=g&hsa_tgt=aud-1602663353754:kwd-818102669426&hsa_kw=eleiko%20open%20trap%20bar&hsa_mt=b&hsa_net=adwords&hsa_ver=3&gclid=Cj0KCQiAic6eBhCoARIsANIox86F9UsAnJjN-h_D-FMBUVDpwE2JA0eJNQF-GiMKPAugpvCh3YIZTQaAiRHEALw_wcB, offered for sale as early as Jun. 14, 2022, 7 pages.

Elite FTS, American Cambered Grip Bar, located on Internet WayBack Machine archive on Jul. 2, 2021 at: http://web.archive.org/web/20210702163506/https://www.elitefts.com/american-cambered-grip-bar.html, 4 pages.

Kabuki Strength, the Kadillac Bar, located on Internet WayBack Machine archive on Sep. 11, 2020 at: http://web.archive.org/web/20200911142425/https://store.kabukistrength.net/products/the-kadillac-bar, 6 pages.

Kabuki Strength, the Trap Bar HD, located on Internet WayBack Machine archive on Sep. 11, 2020 at: http://web.archive.org/web/20200911141719/https://store.kabukistrength.net/products/the-trap-bar, 9 pages.

Titan Fitness, Multi-Grip Camber Bar, located on Internet WayBack Machine archive on Sep. 5, 2020 at: http://web.archive.org/web/20200905042815/https://www.titan.fitness/strength/barbells/specialty/multi-grip-camber-bar/430047.html, 2 pages.

European patent application, No. 23179133.6, Extended European Search Report dated Jan. 25, 2024.14 pages.

European patent application No. 23179133.6, Communication pursuant to Article 94(3) dated Mar. 13, 2025. 18 pages.

New King of Multi Bars? Rep Fitness Cambered Swiss Bar Review, Gluck's Gym, as shown in www.YouTube.com, Feb. 10, 2022. (Year: 2022).

REP Fitness Cambered Swiss Bar Unboxing and Impressions!, Garage Gym Reviewd, as shown in www.YouTube.com, Feb. 17, 2022. (Year: 2022).

Wolverson Cambered Multi Grip Olympic Swiss Bar, as shown in www.wolverson-fitness.uk, no date listed. (Year: NA) (Year: NA).

Wolverson Fitness post, as shown in www.facebook.com, Jul. 23, 2023. (Year: 2023).

* cited by examiner

OPEN TRAP-CAMBER BAR WITH SELF-BRACING REMOVABLE HANDLES

CROSS-REFERENCE TO RELATED APPLICATIONS

This application claims the benefit of priority to U.S. Provisional Application No. 63/351,847, filed Jun. 14, 2022, which application is hereby incorporated in its entirety by reference.

INTRODUCTION

Free weight exercise devices such as barbells may be loaded on both sides with weight plates to add resistance to exercises such as squats, deadlifts, shrugs, curls, etc. Common barbells are straight and may be used for a variety of exercises. Straight barbells, while versatile, are not always desired by all weightlifters. For inexperienced lifters, or those with mobility limitations, deadlifts using a straight bar can cause interference with the knees or shins, which can lead to scraping or bruising. Straight barbells may also be difficult to load, e.g., when placed high on the supports of a squat rack. Specialty bars such as camber bars may be rested on the shoulders and used when performing exercises such as squats or lunges.

SUMMARY

In one aspect, the technology relates to an exercise device including: a substantially U-shaped bar including a centrally-disposed portion and two ends; an interface disposed at each of the two ends; a leg secured to each interface, wherein each leg includes a pair of tapered projections extending from the interface and wherein each leg defines a leg opening; a plate-support post secured to each interface, wherein each plate-support post includes: a first end extending away from the interface and for receiving thereon a plurality of weight plates, and a second end disposed within the interface and defining a threaded bore; a handle unit removably secured proximate each interface and including a handle base at least partially defining a handle opening and a pair of receivers; and a screw for removably securing each handle unit to the leg proximate each interface, wherein the screw extends into the handle opening and leg opening and is threadably received in the threaded bore, and wherein when the screw is received in the threaded bore, each of the pair of receivers receives one of the pair of tapered projections. In an example, the handle unit further includes a flange extending from opposite ends of the handle base and at least one handle spanning the flanges. In another example, when the screw is received in the threaded bore, the base of each handle unit is spaced apart from the leg by a gap. In yet another example, when the screw is received in the threaded bore, at least one of the receivers at least partially contacts a tapered portion of at least one of the pair of projections. In still another example, the handle opening defines a throat.

In another example of the above aspect, for each plate-support post, the second end of the plate-support post defines a hollow receiver and includes: an insert received within the hollow receiver, wherein the insert defines the threaded bore; and a dowel extending through the second end of the plate-support post and the insert, wherein the dowel is disposed substantially orthogonal to an axis of the threaded bore. In an example, each interface further includes a U-shaped frame including a frame base and two frame arms, wherein the leg spans and is fixed to the two frame arms and wherein the leg opening is disposed between the two frame arms. In another example, the leg opening is configured to at least partially receive the second end of the plate-support post. In yet another example, the plate-support post includes a flange, and wherein the flange is fixed to the frame base with a plurality of fasteners. In still another example, the plate-support post includes a plate collar disposed between the flange and the first end of the plate-support post.

In another example of the above aspect, the plate-support posts define an axis and the leg includes a leg plate disposed substantially orthogonal to the axis, wherein the leg plate includes a leg width adjacent the frame and a foot disposed on an end of each leg distal from the interface, and wherein the foot includes a foot width greater than the leg width. In an example, the exercise device further includes a counterweight secured to each side of the leg plate of each leg.

In another aspect, the technology relates to a kit for useful in forming an exercise device, the kit includes: (a) a substantially U-shaped bar including: a centrally-disposed portion; two end portions; an interface welded to each of the two end portions; and a leg secured to each interface and extending away from the substantially U-shaped bar; and; a pair of tapered projections secured to each leg; (b) two plate-support posts, each including: a first end; a second end; a collar disposed between the first end and second end; and a flange disposed between the collar and second end, wherein each second end defines a threaded bar; and (c) a handle unit configured to be removably secured to each interface, wherein each handle unit includes: a base defining a pair of washer receivers and a screw opening disposed between the pair of washer receivers; two flanges extending substantially orthogonally from the base; a handle spanning the flanges; and a screw configured to pass through the screw opening and to be removably secured in the threaded bore, wherein when the screw is removably secured in the threaded bore, the pair of tapered projections projects into the pair of receivers, and the base and the interface define a gap therebetween.

In another aspect, the technology relates to a method of manufacturing a plate-support post for an exercise device, the method includes: providing a plate-support post defining an interior bore; welding a plate collar to the plate-support post; welding a flange to the plate-support post; forming a hole through the plate-support post substantially orthogonal to the interior bore; providing an insert defining a threaded bore; forming a hole through the insert substantially orthogonal to the threaded bore; inserting the insert into the interior bore; aligning the hole through the plate-support post with the hole through the insert; inserting a dowel into the aligned holes to at least partially secure the plate-support post to the insert; and welding the insert to the plate-support post after inserting the dowel.

BRIEF DESCRIPTION OF THE DRAWINGS

The following drawing figures, which form a part of this application, are illustrative of described technology and are not meant to limit the scope of the disclosure as claimed in any manner, which scope shall be based on the claims appended hereto.

DETAILED DESCRIPTION

Figure 1:
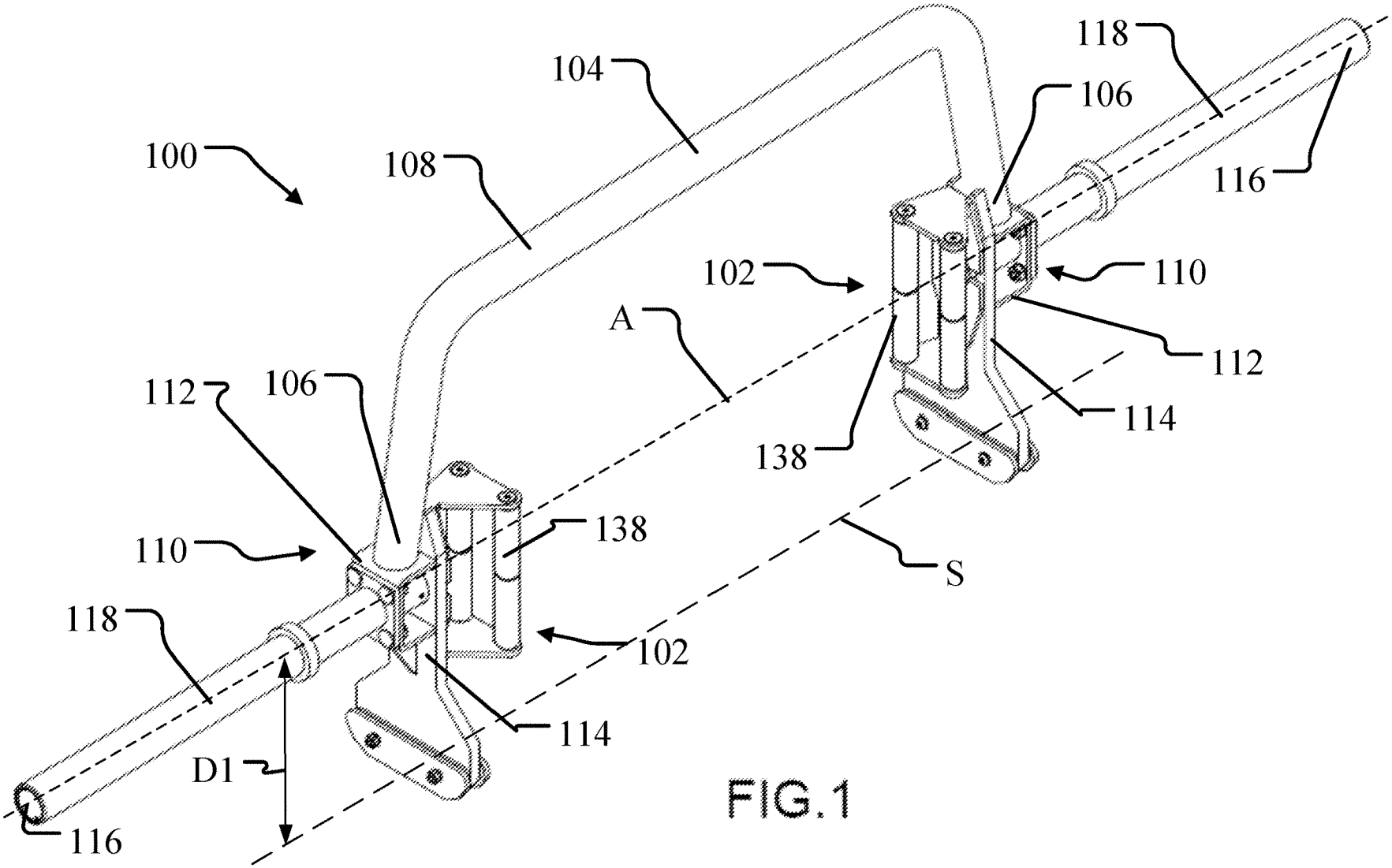
FIG. 1 depicts a schematic view of an open trap-camber bar in accordance with one example.
Figure 2:
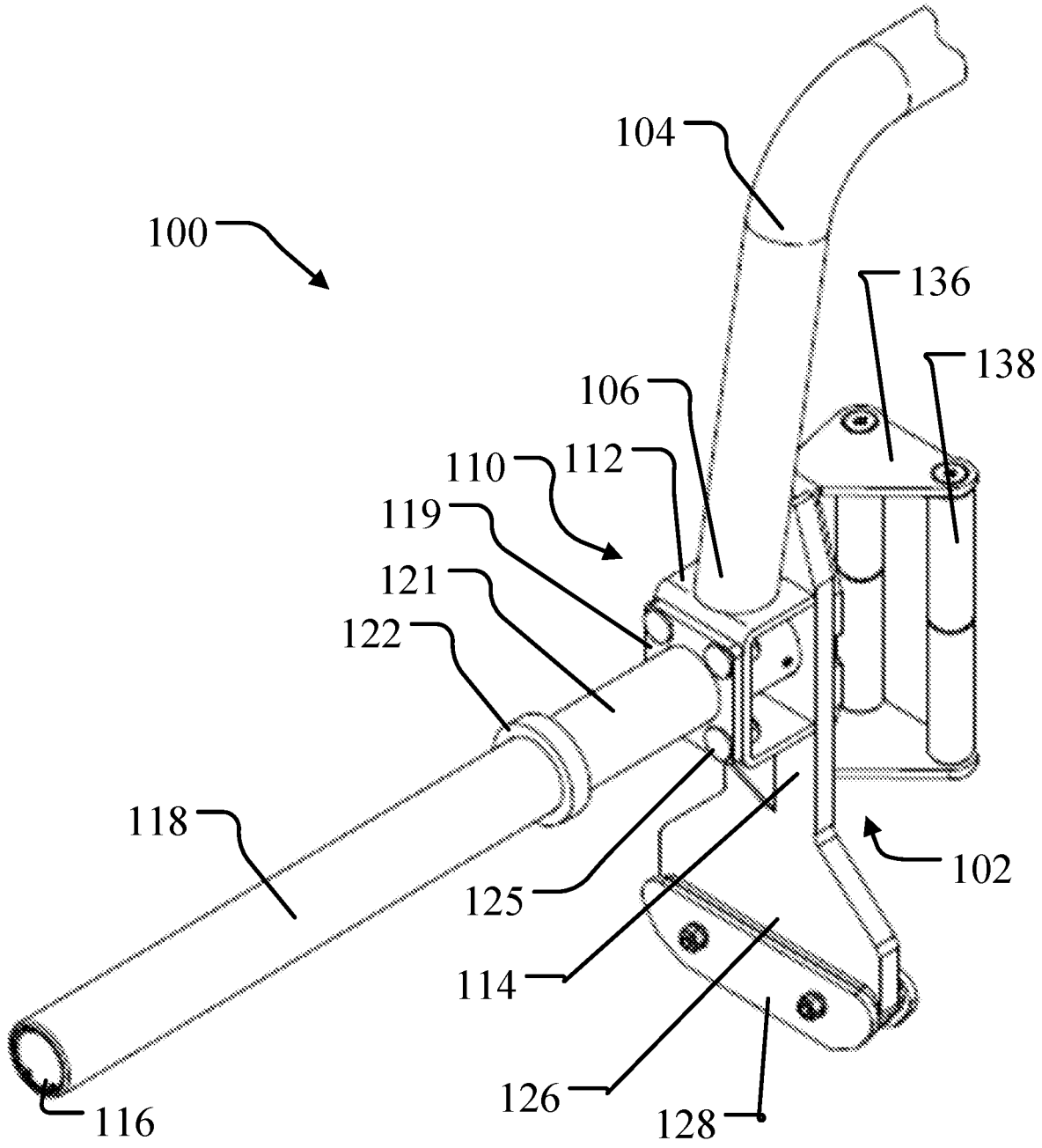
FIG. 2 depicts an enlarged perspective view of a handle unit/bar interface of the open trap-camber bar of FIG. 1.
Figure 3:
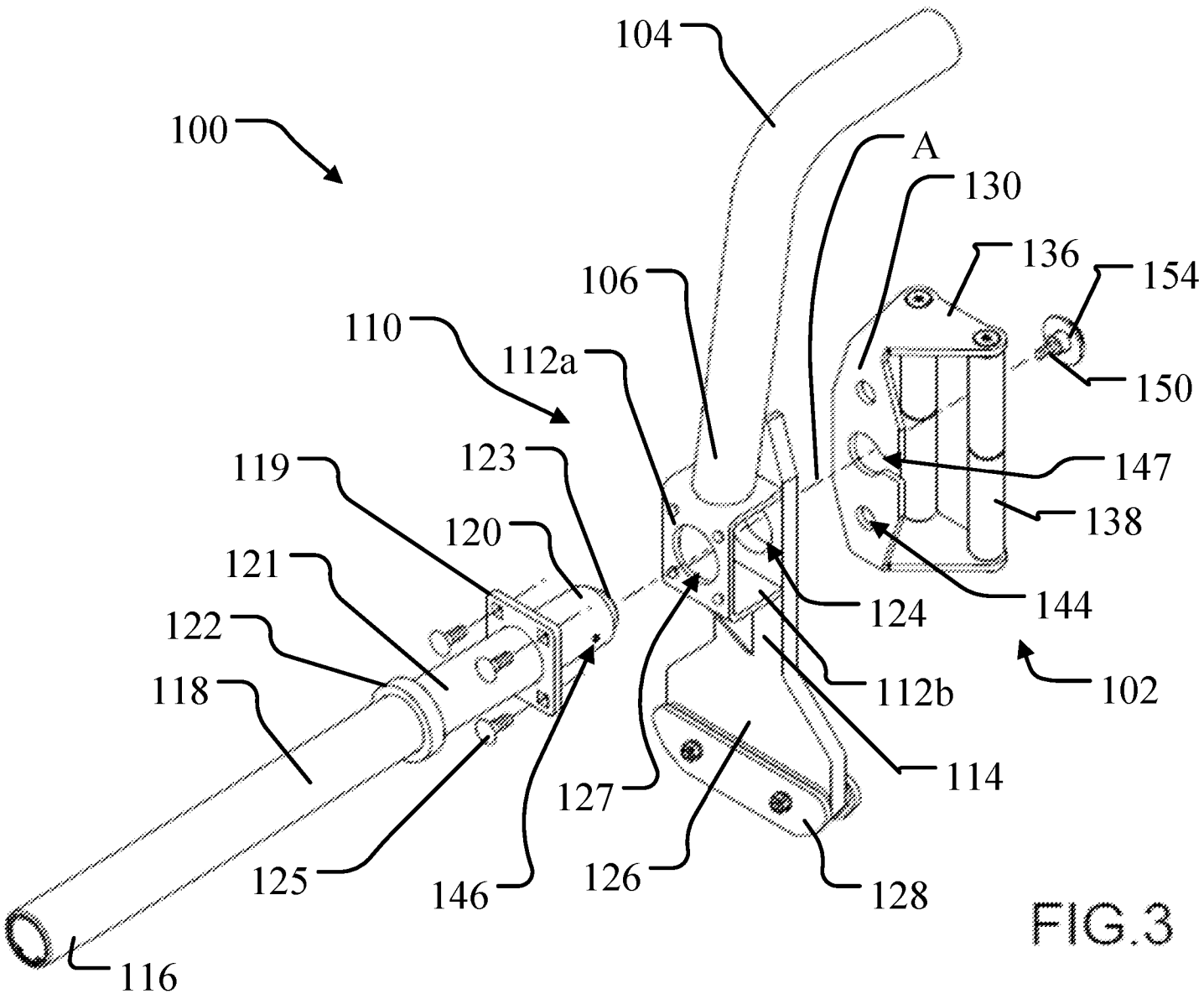
FIG. 3 depicts a first exploded enlarged perspective view of the handle unit/bar interface of FIG. 1.
Figure 4:
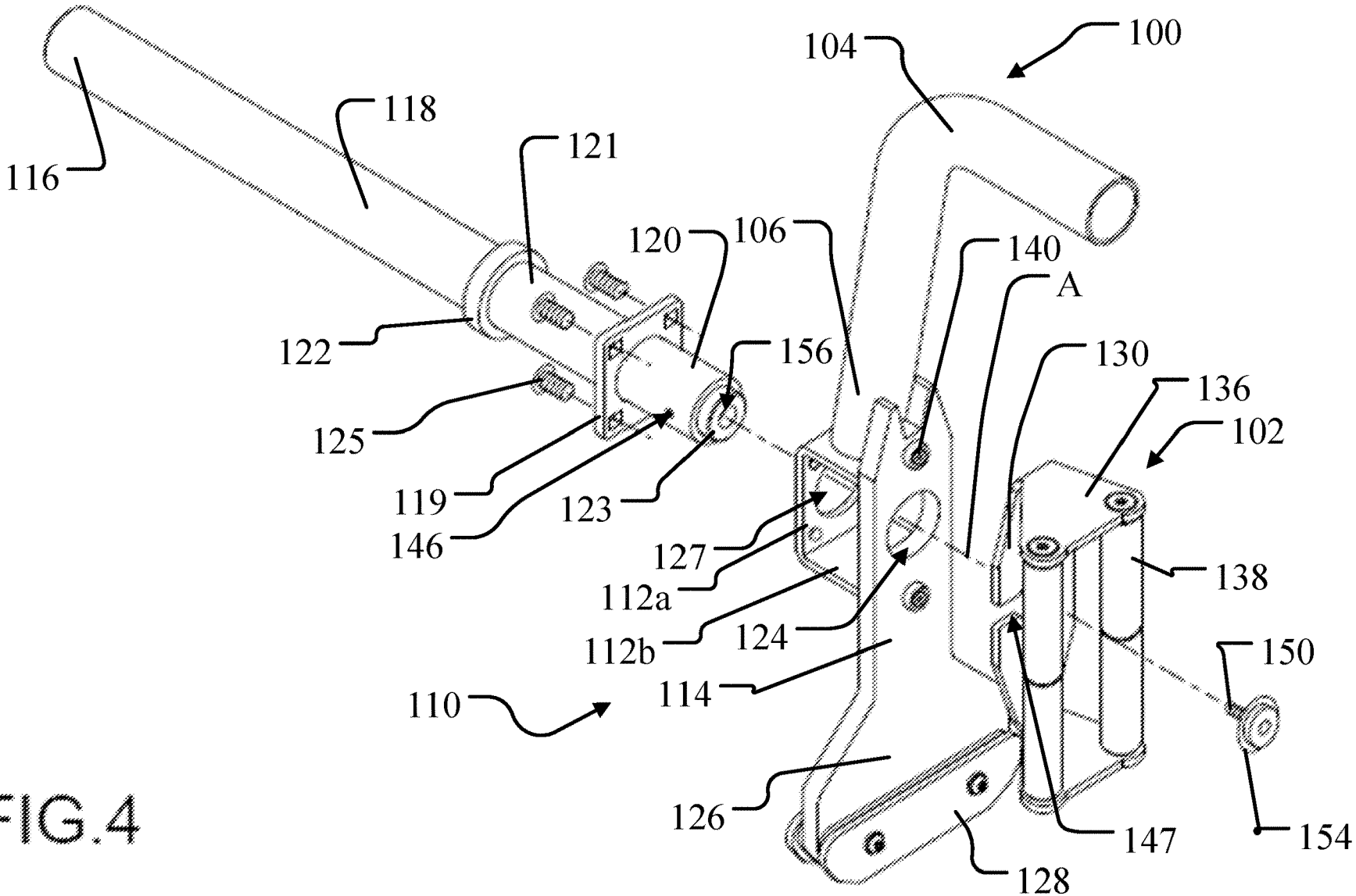
FIG. 4 depicts a second exploded enlarged perspective view of the handle unit/bar interface of FIG. 1.
Figure 5:
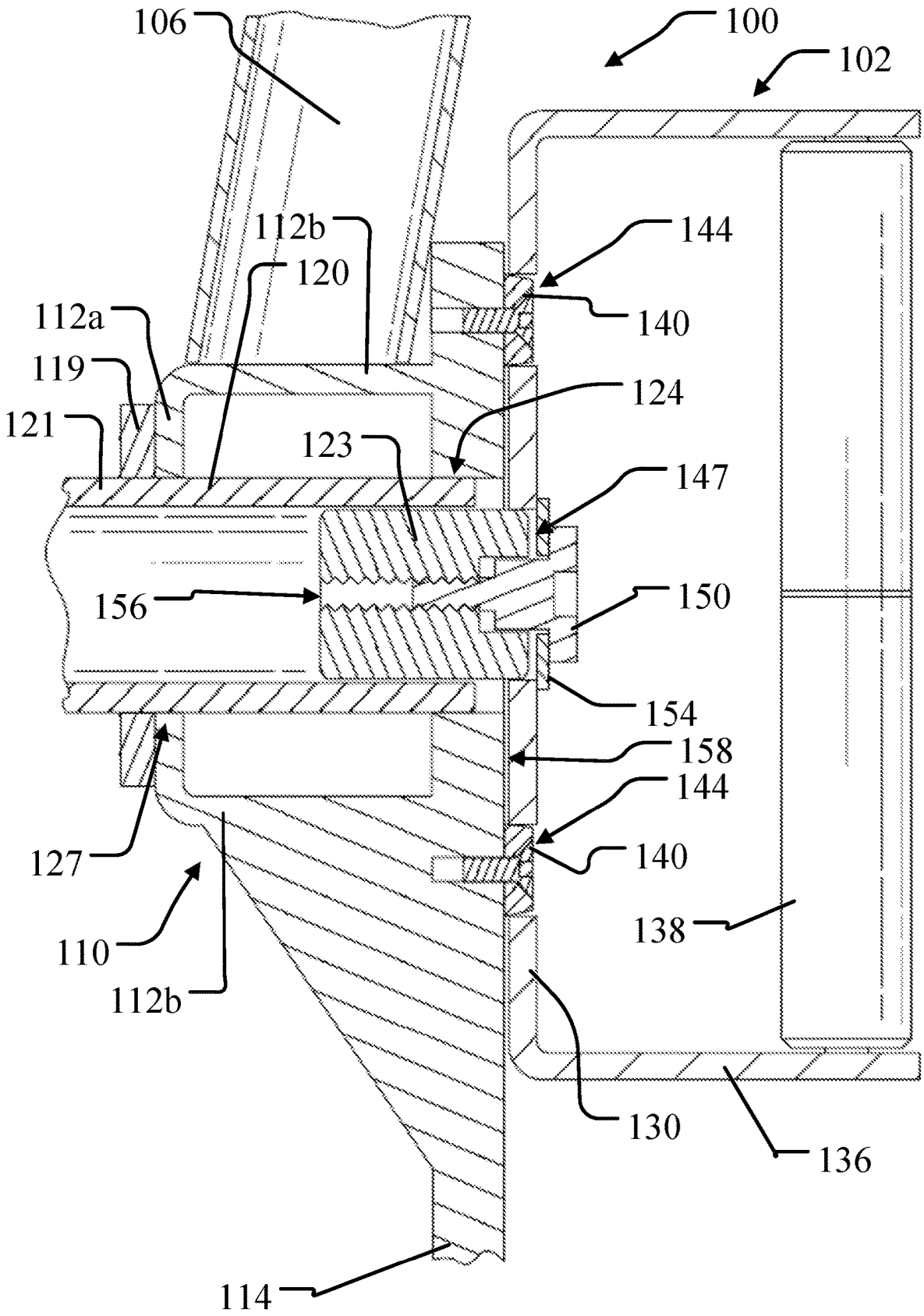
FIG. 5 depicts a partial enlarged sectional view of the handle unit/bar interface of FIG. 1.

FIGS. 1-5 depict various views of a combination open trap-camber bar 100. The figures are described concurrently and not all components of the combination bar 100 are depicted or labeled in every figure. The combination bar 100 may be used for a variety of weighted or unweighted exercises. For example, with the handle units 102 present, the combination bar 100 may be gripped thereby and may be used for trapezius shrugs, modified deadlifts, farmer's walks, hammer curls, etc. With the handle units 102 removed, the bar 100 may rest on a user's shoulders and used for squats, lunges, etc., though such exercises may be performed with the handle units 102 present. Other exercises may be performed, with or without additional weights. When used for squats, the posts on which weight plates are loaded may be lower to the ground, easing loading and unloading thereof.

The combination bar 100 includes a substantially U-shaped bar 104 having two ends 106 and a centrally-disposed portion 108. The two ends 106 may be orthogonal or substantially orthogonal to the centrally-disposed portion 108, but typically are disposed at an angle, such as depicted. This angled configuration allows the combination bar 100 to be used for squat or lunge exercises, where the centrally-disposed portion 108 is placed on the shoulders of a user. In this way, the angled configuration allows for particularly large persons to easily fit within the two ends 106. The two ends 106 terminate at interfaces 110, to which other components of the combination bar 100 are fixedly or removably secured. The interfaces 110 may include a frame structure 112 that may be open or closed on certain sides thereof. In this example, the frame structure 112 is a substantially U-shaped component including a frame base 112*a* and two frame arms 112*b* extending therefrom. Each end 106 of the substantially U-shaped bar 104 is welded to one of the frame arms 112*b*. In other examples, removable fasteners such as bolts or screws (such as used to connect plate-support posts 116 to the interfaces 110) may alternatively be utilized. A leg 114 extends downward from each interface 110 away from the U-shaped bar 104. In this example, the leg 114 is welded to the two arms 112*b* of the frame 112 although removable fasteners may also be used. The leg 114 is a substantially flat plate and may also be welded to the substantially U-shaped bar 104 for additional stability. A plate-support post 116 is secured to the frame 112, in this case, with a plurality of bolts 125 or other mechanical fasteners that connect a flange 119 of the plate-support post 116 to the frame base 112*a*. In various examples, for components that are secured to the frame structure 112, welding, brazing, industrial adhesives, bolts or mechanical fasteners, or other implements for robust connections, may be utilized. The choice of connection may be as required or desired for a particular application, based on proposed usage, loading expectations, component material selected, product packaging and shipping considerations, etc.

The plate-support post 116 includes a first projecting end 118 and a second securing end 120 separated by a collar 122. The projecting end 118 is sized and configured to be received within standard weight plates (not shown), which are well-known in the art. One or more weight plates may be slid onto the projecting end 118 until the innermost weight plate abuts the collar 122. A locking collar (not shown) may be secured against the outermost weight plate as known in the art, prior to use of the combination bar 100. Between the collar 122 and the flange 119 is a rest 121, which may be placed on a support structure, such as a squat rack, between exercises. In other examples, the centrally-disposed portion 108 may be used to support the combination bar 100 on a more narrow squat rack. When rested on a squat rack at the rests 121, the centrally-disposed portion 108 is typically at the shoulder height of a user; as such, the projecting ends 118 would be lower, allowing for easier plate loading.

In addition to the flange 119, the second securing end 120 may be hollow and have inserted therein an insert 123 that may be flushed, recessed in, or projecting from the securing end 120. The second securing end 120 projects into the frame 112 of the interface 110. As can be seen primarily in FIG. 3, a portion of the leg 114 proximate the interface 110 defines a leg opening 124 for at least partially receiving the second securing end 120 of the plate-support post 116 or the insert 123 if that component projects particularly far from the second securing end 120. In certain examples, the leg opening 124 may be sized to contact an outer perimeter of the second securing end 120, or the leg opening 124 may be slightly smaller and configured to only receive the insert 123. Thus, the plate-support post 116 may be supported at a plurality of locations (e.g., the flange 119/frame 112 interface and at the second securing end 120/leg opening 124 interface) for a robust connection that is used to counter the weight applied to the plate-support post 116 when heavily loaded with plates. In addition to the bolts 125 that connect the flange 119 to the frame 112, the multiple support locations distribute forces along the second securing end 120 to help prevent bending of the plate-support post 116.

Each leg 114 extends downward from its associated interface 110 and may be substantially parallel to the end 106, or disposed at an angle thereto. The leg 114 terminates at foot 126. The foot 126 has a width wider than a width of the leg 114 proximate the interface 110, which improves stability. When the combination bar 100 is supported on the feet 126, the length of the leg 114 (specifically, a distance D1 from an axis A to the furthest extent of the foot 126 therefrom) elevates the plate-support post 116 such that weight plates may be placed thereon, without having to lift the combination bar 100 further from a surface S on which the feet 126 rest. The largest of such weight plates are typically 45 pounds, and manufactured in common dimensions, e.g., with regard to plate diameter. Other, heavier weights with different dimensions may also be accommodated based on the length of the legs 114. The legs 114 and feet 126 of the present combination bar 100 may be manufactured so as to accommodate the largest plates available. In examples, one or more counterweights 128 may be secured to either side of the flat plates that form the legs 114 and feet 126, typically proximate the feet 126. As the legs 114 extend in a direction generally opposite of the end portions 106 of the centrally-disposed portion 108 of the bar 104 (e.g., the legs 114 and the bar 104 are generally coplanar), the counterweights 128 may be sized so as to balance the weight of bar 104. Thus, when the combination bar 100 is resting on weight plates loaded on the plate-support posts 116, neither of legs 114 or bar 104 fall towards the floor. This may also render the combination bar 100 easier to hold during exercises. In another example, the counterweights 128 provide sufficient weight balance such that when the combination bar 100 is resting on the rests 121

(e.g., on a squat rack), the bar 104 may remain upright so as to improve user positioning of the combination bar 100 on the shoulders. The foot 126 may also include a durable resilient material (not shown), which may at least partially encase the foot 126 and/or counterweights 128. The durable material may be of rigid or semi-rigid rubber or plastic, secured so as to reduce impact when the combination bar 100 is dropped or otherwise lowered onto the floor. The durable resilient material may also increase the width of the foot 126, further increasing stability.

The combination bar 100 may be used as both an open trap bar (e.g., for shugs, deadlifts, lunges, etc.) and as a camber bar (e.g., for squats, lunges, etc.). During use as a camber bar, as noted above, the bar 104 rests on the shoulders. While some smaller users may be able to rest the bar 104 on the shoulders with the handle units 102 in place, other users will require or prefer that the handle units 102 be removed. This removal of the handle unit 102 enables increased versatility of the bar 100. Certain components of the handle unit 102 are most clearly depicted in FIGS. 3, 4, and 5. The handle unit 102 includes a handle base 130 having a first side facing the leg 114 when secured thereto, and a second side facing away from the leg 114 and towards the handles 138. Two flanges 136 project outward from ends of the handle base 130 and may be secured by welding. In another example, the handle base 130 may be an elongate component, bent at the ends to form the flanges 136. In the depicted example, two handles 138 span the flanges 136, and provide a location to grip and lift the combination bar 100. The handles 138 may be parallel or disposed at a slight angle. In other examples, a single handle may be utilized, although multiple handles may increase versatility by allowing a lifter to grip whichever handle 138 is the most comfortable, or that is beneficial to his or her particular exercise.

The base 130 of the handle unit 102 defines a plurality of receivers or openings. In the depicted example, these include a pair of receivers 144 and a handle opening 147 centrally disposed between the pair of receivers 144. The handle unit 102 is removably secured to the combination bar 100 proximate the interface 110. A screw, bolt, or other threaded fastener 150 is passed through an optional washer 154, through the handle opening 147, and into the leg opening 124, where it is threadedably secured in the threaded bore 156. The handle opening 147 may include a throat as depicted to allow for removal or connection of the handle unit 102 without complete disconnection of the screw 150. A projection 140 (which may be in the form of a tapered washer secured to the leg 114) extends from the leg 114 and is sized to be received in each receiver 144. More specifically, each projection 140 extend into an associated receiver 144 such that a portion of the receiver 144 contacts a tapered outer surface of the projection 140. Contact is such that a gap 158 is formed between the leg 114 and base 130. The gap 158 may be about ¼ mm, ½ mm, 1 mm, 1½ mm, or greater. Since the surfaces of the leg 114 and base 130 are not in contact, movement of the handle unit 102 relative to the leg is substantially or entirely eliminated, enabling a robust connection thereof without rattled or loosening of the handle unit 102.

The configuration of the interface 110 further ensures a robust connection of any non-welded components (here, e.g., the plate-support posts 116 and handle units 102) is maintained, even as the combination bar 100 is regularly dropped. The substantially U-shaped frame 112 effectively acts as a spring, biasing the screw 150 away from the projecting end 118 of the plate-support posts 116. This spring force is increased as the screw 150 is tightened, thereby drawing the flange 119 against the base 112*a* of the frame 112. The screw 150 may include a hex wrench interface or otherwise to tighten or loosen the screw. A screw having a head in a wing nut configuration may also be used to eliminate the need for tools.

Figure 6:
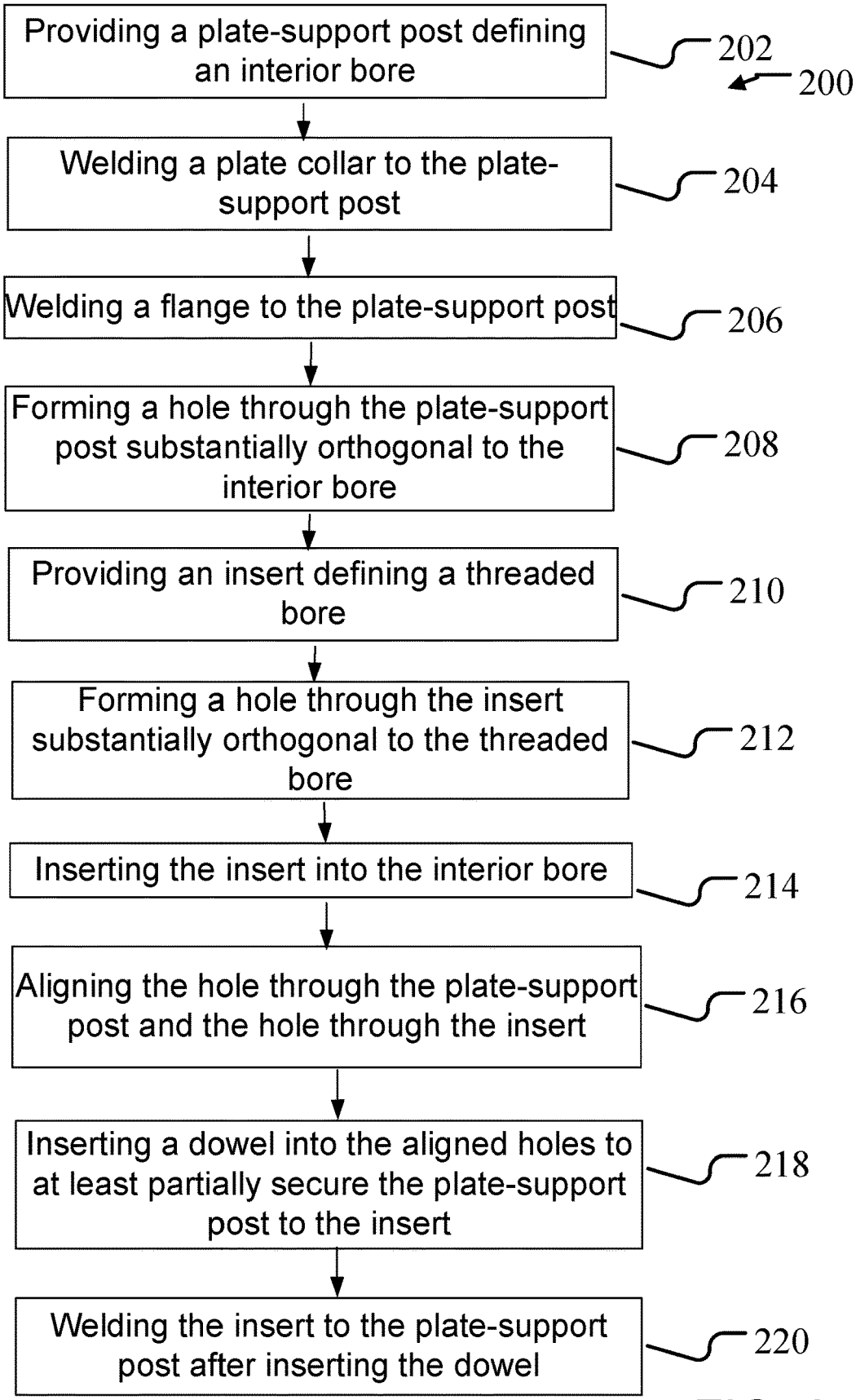
FIG. 6 depicts a method of manufacturing a plate-support post for an exercise device.

FIG. 6 depicts a method 200 of manufacturing a plate support post for an exercise device. The method 200 includes providing a plate-support post defining an interior bore, operation 202. In operation 204, a plate collar is welded to the plate-support post, and in operation 206, a flange is welded to the plate-support post. Operation 208 includes forming a hole through the plate-support post substantially orthogonal to the interior bore. Operations 204-208 may be performed in any order. The method also includes providing an insert defining a threaded bore, operation 210 and forming a hole through the insert, operation 212. Like the hole formed in operation 208, the hole formed in the insert is substantially orthogonal to the threaded bore. Thereafter, the insert is inserted into the interior bore, operation 214. Operation 216 includes aligning the hole through the plate-support post and the hole through the insert. Once aligned, a dowel 146 is inserted into the aligned holes to at least partially secure the plate-support post to the insert, operation 218. Insertion of the dowel 146 allows the position of the insert relative to the plate-support post to be maintained while operation 220, welding the insert to the plate-support post is performed. The finished plate-support post may then be connected to the other components described herein so as to form the combination bar described herein, or may be packaged and shipped/sold as a kit as described below.

The exercise device described herein may be sold as a kit, either in a single package or in multiple packages. A kit may include a substantially U-shaped bar, two interfaces, two legs/feet, and two plate support posts, along with any required fasteners. If desired, the U-shaped bar, interfaces, and legs/feet may be permanently fixed to each other, e.g., welding, although instructions included with the kit may also specify methods of connecting such components.

It is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular examples only and is not intended to be limiting. It must be noted that, as used in this specification, the singular forms "a," "an," and "the" include plural referents unless the context clearly dictates otherwise.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified examples. In this regard, any number of the features of the different examples described herein may be combined into one single example and alternate examples having fewer than or more than all of the features herein described are possible.

While various examples have been described for purposes of this disclosure, various changes and modifications may be made which are well within the scope contemplated by the present disclosure. Numerous other changes may be made which will readily suggest themselves to those skilled in the art and which are encompassed in the spirit of the disclosure.

What is claimed is:

1. An exercise device comprising:

a substantially U-shaped bar comprising a centrally-disposed portion and two ends;

an interface disposed at each of the two ends;

a leg secured to each interface, wherein each leg comprises a pair of tapered projections extending from the interface and wherein each leg defines a leg opening;

a plate-support post secured to each interface, wherein each plate-support post comprises: a first end extending away from the interface and for receiving thereon a plurality of weight plates, and a second end disposed within the interface and defining a threaded bore along a longitudinal axis of the plate-support post;

a handle unit removably secured proximate each interface and comprising a handle base at least partially defining a handle opening and a pair of receivers; and a screw for removably securing each handle unit to the leg proximate each interface, wherein the screw extends into the handle opening and leg opening and is threadably received in the threaded bore, and wherein when the screw is received in the threaded bore, each of the pair of receivers receives one of the pair of tapered projections.

2. The exercise device of claim 1, wherein each interface further comprises a U-shaped frame comprising a frame base and two frame arms, wherein the leg spans and is fixed to the two frame arms and wherein the leg opening is disposed between the two frame arms.

3. The exercise device of claim 2, wherein the leg opening is configured to at least partially receive the second end of the plate-support post.

4. The exercise device of claim 3, wherein the plate-support post comprises a flange, and wherein the flange is fixed to the frame base with a plurality of fasteners.

5. The exercise device of claim 4, wherein the plate-support post comprises a plate collar disposed between the flange and the first end of the plate-support post.

6. The exercise device of claim 1, wherein the handle unit further comprises a flange extending from opposite ends of the handle base and at least one handle spanning the flanges.

7. The exercise device of claim 6, wherein when the screw is received in the threaded bore, the base of each handle unit is spaced apart from the leg by a gap.

8. The exercise device of claim 7, wherein when the screw is received in the threaded bore, at least one of the pair of receivers at least partially contacts a tapered portion of at least one of the pair of tapered projections.

9. The exercise device of claim 1, wherein each interface further comprises a U-shaped frame, wherein the plate-support posts define the longitudinal axis and the leg comprises a leg plate disposed substantially orthogonal to the longitudinal axis, wherein the leg plate comprises a leg width adjacent the U-shaped frame and a foot disposed on an end of each leg distal from the interface, and wherein the foot comprises a foot width greater than the leg width.

10. The exercise device of claim 9, further comprising a counterweight secured to each side of the leg plate of each leg.

11. The exercise device of claim 1, wherein the handle opening defines a throat.

12. The exercise device of claim 1, wherein for each plate-support post, the second end of the plate-support post defines a hollow receiver and comprises:

an insert received within the hollow receiver, wherein the insert defines the threaded bore; and a dowel extending through the second end of the plate-support post and the insert, wherein the dowel is disposed substantially orthogonal to the longitudinal axis of the plate support post.

13. A kit forming an exercise device, the kit comprising:

(a) a substantially U-shaped bar comprising:

a centrally-disposed portion;

two end portions;

an interface welded to each of the two end portions; and a leg secured to each interface and extending away from the substantially U-shaped bar; and;

a pair of tapered projections secured to each leg;

(b) two plate-support posts, each comprising:

a first end;

a second end;

a collar disposed between the first end and second end; and a flange disposed between the collar and second end, wherein each second end defines a threaded bore along a longitudinal axis of each plate-support post; and (c) a handle unit configured to be removably secured to each interface, wherein each handle unit comprises:

a base defining a pair of washer receivers and a screw opening disposed between the pair of washer receivers;

two flanges extending substantially orthogonally from the base;

a handle spanning the two flanges; and a screw configured to pass through the screw opening and to be removably secured in the threaded bore, wherein when the screw is removably secured in the threaded bore, the pair of tapered projections projects into the pair of washer receivers, and the base and the interface define a gap therebetween.

14. A method of manufacturing a plate-support post for an exercise device, the method comprising:

providing a plate-support post defining an interior bore;

welding a plate collar to the plate-support post;

welding a flange to the plate-support post;

forming a hole through the plate-support post substantially orthogonal to the interior bore;

providing an insert defining a threaded bore;

forming a hole through the insert substantially orthogonal to the threaded bore;

inserting the insert into the interior bore;

aligning the hole through the plate-support post with the hole through the insert;

inserting a dowel into the aligned holes to at least partially secure the plate-support post to the insert; and welding the insert to the plate-support post after inserting the dowel.

* * * * *